US008391531B2

(12) United States Patent
Harano et al.

(10) Patent No.: US 8,391,531 B2
(45) Date of Patent: Mar. 5, 2013

(54) CONDENSER MICROPHONE

(75) Inventors: Hiroyuki Harano, Fukuoka (JP); Hiroshi Yamagata, Fukuoka (JP); Kazuo Ono, Fukuoka (JP); Kensuke Nakanishi, Fukuoka (JP)

(73) Assignee: Hosiden Corporation, Osaka (JP)

( * ) Notice: Subject to any disclaimer, the term of this patent is extended or adjusted under 35 U.S.C. 154(b) by 321 days.

(21) Appl. No.: 12/816,615

(22) Filed: Jun. 16, 2010

(65) Prior Publication Data

US 2011/0002483 A1 Jan. 6, 2011

(30) Foreign Application Priority Data

Jul. 3, 2009 (JP) ..... 2009-158901

(51) Int. Cl.
*H04R 21/02* (2006.01)
*H04R 25/00* (2006.01)

(52) U.S. Cl. ..... 381/369; 381/174

(58) Field of Classification Search ..... 381/369, 381/174

See application file for complete search history.

(56) References Cited

U.S. PATENT DOCUMENTS 5,224,474 A * 7/1993 Bloomfield ..... 128/201.19
7,233,674 B2 * 6/2007 Song ..... 381/174
7,349,551 B2 * 3/2008 Skillicorn et al. ..... 381/384
7,620,197 B2 * 11/2009 Han et al. ..... 381/369
7,907,743 B2 * 3/2011 Izuchi et al. ..... 381/174
8,050,443 B2 * 11/2011 Izuchi et al. ..... 381/357
8,059,850 B2 * 11/2011 Chan ..... 381/355
8,175,299 B2 * 5/2012 Song et al. ..... 381/174
2006/0285707 A1 * 12/2006 Izuchi et al. ..... 381/191
2007/0297636 A1 * 12/2007 Feng ..... 381/396
2008/0166003 A1 7/2008 Hankey et al.
2009/0169034 A1 * 7/2009 Song et al. ..... 381/174

* cited by examiner

*Primary Examiner* — Jeffrey Donels
(74) *Attorney, Agent, or Firm* — The Webb Law Firm

(57) ABSTRACT

There is provided a condenser microphone that has improved portability and that can be realized at low costs. The condenser microphone includes, as all being accommodated within a cylindrical housing, a capacitor including a diaphragm electrode and a fixed electrode, a signal processing circuit board disposed at one opening of the cylindrical housing and having a converter circuit for converting a change in capacitance of the capacitor which has occurred in association with vibration of the diaphragm electrode into an electric signal and outputting this electric signal, a gate ring disposed between the capacitor and the signal processing circuit board for establishing electric conduction therebetween, a switch circuit board disposed at the other opening of the cylindrical housing and having a switch for controlling operation of the converter circuit, and a drain ring disposed between the switch circuit board and the signal processing circuit board for transmitting a switch signal according to an operation of the switch to the signal processing circuit board.

7 Claims, 5 Drawing Sheets

CONDENSER MICROPHONE

BACKGROUND OF THE INVENTION

1. Field of the Invention

The present invention relates to a condenser microphone configured to convert a change in capacitance of a capacitor comprised of a diaphragm electrode and a fixed electrode into an electric signal.

2. Description of the Related Art

Conventionally, when an audio signal is transmitted between a mobile computer (or phone) and an earphone or a speaker, the method widely employed for this purpose is using a cable for connecting the mobile computer (or phone) to the earphone or speaker. With an earphone set or speaker set produced with using this method, the earphone or speaker is connected to one end of the cable and a plug to be inserted into a jack of the mobile computer (or phone) is connected to the other end of the cable. One exemplary technique relating to such earphone or speaker set as above is disclosed in U.S. Patent Application Publication Serial No. 2008/0166003.

The technique disclosed in U.S. Patent Application Publication Serial No. 2008/0166003 concerns a headset having an earphone connected to one end of a cable and a plug connected to the other end of the cable. With this headset, there is also provided a switch between the earphone and the plug and a switch mechanism (e.g. a switch button) is mounted on a circuit board provided separately from a microphone constituting the earphone. Thus, the construction requires the circuit board for mounting the switch mechanism, thus leading to enlargement of the switch mechanism, which presents in turn a problem in portability. Further, if a clip or the like is to be provided to the switch mechanism for allowing this mechanism to be hooked to a piece of clothes, this would result in further enlargement of the switch mechanism. And, if a clip or the like is to be provided to the microphone also, providing the clips or the like to the microphone and the switch mechanism separately would cause disadvantageous cost increase.

SUMMARY OF THE INVENTION

The present invention has been made in view of the above-described state of the art. Its principal object is to provide a condenser microphone that has improved portability and that can be realized at low costs.

For accomplishing the above-noted object, a condenser microphone, according to the present invention, comprises, as all being accommodated within a cylindrical housing:

a capacitor including a diaphragm electrode and a fixed electrode;

a signal processing circuit board disposed at one opening of the cylindrical housing and having a converter circuit for converting a change in capacitance of the capacitor which has occurred in association with vibration of the diaphragm electrode into an electric signal and outputting this electric signal;

a gate ring disposed between the capacitor and the signal processing circuit board for establishing electric conduction therebetween;

a switch circuit board disposed at the other opening of the cylindrical housing and having a switch for controlling operation of the converter circuit; and a drain ring disposed between the switch circuit board and the signal processing circuit board for transmitting a switch signal according to an operation of the switch to the signal processing circuit board.

With the above-described construction, by using the drain ring, a switch signal relating to a switch operation can be transmitted in a favorable manner to the signal processing circuit board. Therefore, even after the condenser microphone has been packaged within a predetermined housing or box, its operational condition can be controlled with the switch. Further, with the above construction provided by the present invention, the condenser microphone and the switch can be provided in a single package. So, a condenser microphone having improved portability can be realized. Furthermore, the single package construction allows for co-use of the housing. And, when a clip is to be provided, this clip too can be co-used. As a result, the condenser microphone can be realized at low costs.

Preferably, the gate ring has an outer diameter smaller than an inner diameter of the drain ring.

With the above arrangement, the gate ring and the drain ring can be provided in the form of a double-layered cylindrical construction. Therefore, the electric connections between the signal processing circuit board and the switch and between the capacitor and the signal processing circuit board can be realized in a compact manner. Thus, the portability of the condenser microphone can be further improved.

Still preferably, a sound hole for introducing vibration applied to the diaphragm electrode is formed in the switch circuit board.

With the above arrangement, sound-relating vibration can be transmitted in a favorable manner to the diaphragm electrode. Hence, sound can be effectively collected at the diaphragm electrode.

Preferably and alternatively, a sound hole for introducing vibration applied to the diaphragm electrode is formed in the signal processing circuit board.

With the above arrangement, the sound hole can be formed at a position less conspicuous. Thus, it is possible to prevent the presence of the sound hole impairing the aesthetic. Further, in particular, when sound holes are used in both the switch circuit board and the signal processing board, the holes can be used in reversible manner.

DESCRIPTION OF THE PREFERRED EMBODIMENTS

Figure 1:
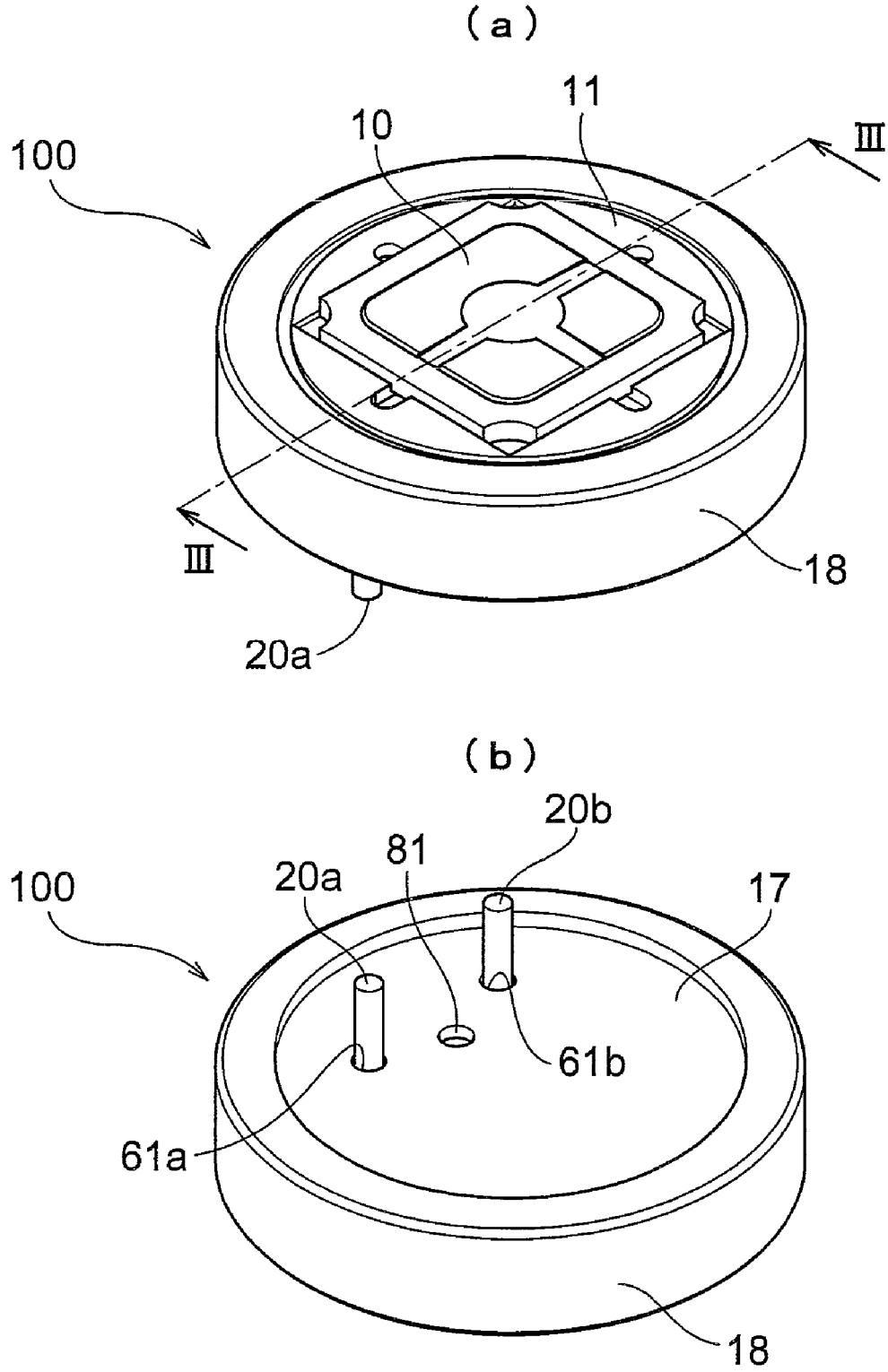
FIG. 1 shows an outer shape of a condenser microphone.

Next, preferred embodiments of the present invention will be described with reference to the accompanying drawings. A condenser microphone 100 of the invention, though will be detailed later, is formed compact with inclusion of a switch 10 for controlling operations of this condenser microphone 100. FIG. 1 (*a*) is a perspective view showing the front surface of the condenser microphone 100 relating to the present embodiment. FIG. 1 (*b*) is a perspective view showing the back surface of the condenser microphone 100.

As shown in FIG. 1, the condenser microphone 100 has its periphery surrounded by a cylindrical capsule 18 with opposed open ends. On the side of one open end of this cylindrical capsule 18, there is provided a switch circuit board 11 (see FIG. 1 (*a*)) and at the side of the other open end of the cylindrical capsule 18, there is provided a signal processing circuit board 17 (see FIG. 1 (*b*)). The signal processing circuit board 17 defines through holes 61*a*, 61*b*, through which a pair of pin connectors 20*a*, 20*b* are disposed.

The switch circuit board 11, though will be detailed later, mounts the switch 10 for controlling the operations of the condenser microphone 100, with the switch 10 being mounted with a predetermined gap relative to this switch circuit board 11. Incidentally, this switch 10 is shown schematically for its wiring pattern only in FIG. 1 (*a*). In fact, the switch 10 will be formed with a switch button 30 (described later) disposed vertically upward of the wiring pattern. Further, the signal processing circuit board 17 includes a sound hole 81 (described later) as shown in FIG. 1 (*b*).

Of the pair of pin connectors 20*a*, 20*b*, one of these acts as an input/output terminal for the condenser microphone 100 and the other acts as a GND terminal. In the case of a construction where the condenser microphone 100 is configured like a microphone to output a collected sound in the form of a sound signal to an externally connected device, one of the pair of pin connectors 20*a*, 20*b* acts as an output terminal and the other of the same acts as a GND terminal. In the case of a further construction where the condenser microphone 100 is configured like an earphone to receive an audio signal transmitted from an externally connected device, one of the pair of pin connectors 20*a*, 20*b* acts as an input terminal and the other of the same acts as a GND terminal. Such pair of pin connectors 20*a*, 20*b* are employed as connecting terminals for connection to external devices. Incidentally, in the following discussion, the condenser microphone 100 will be described as being configured like a microphone for collecting sound from the outside.

Figure 2:
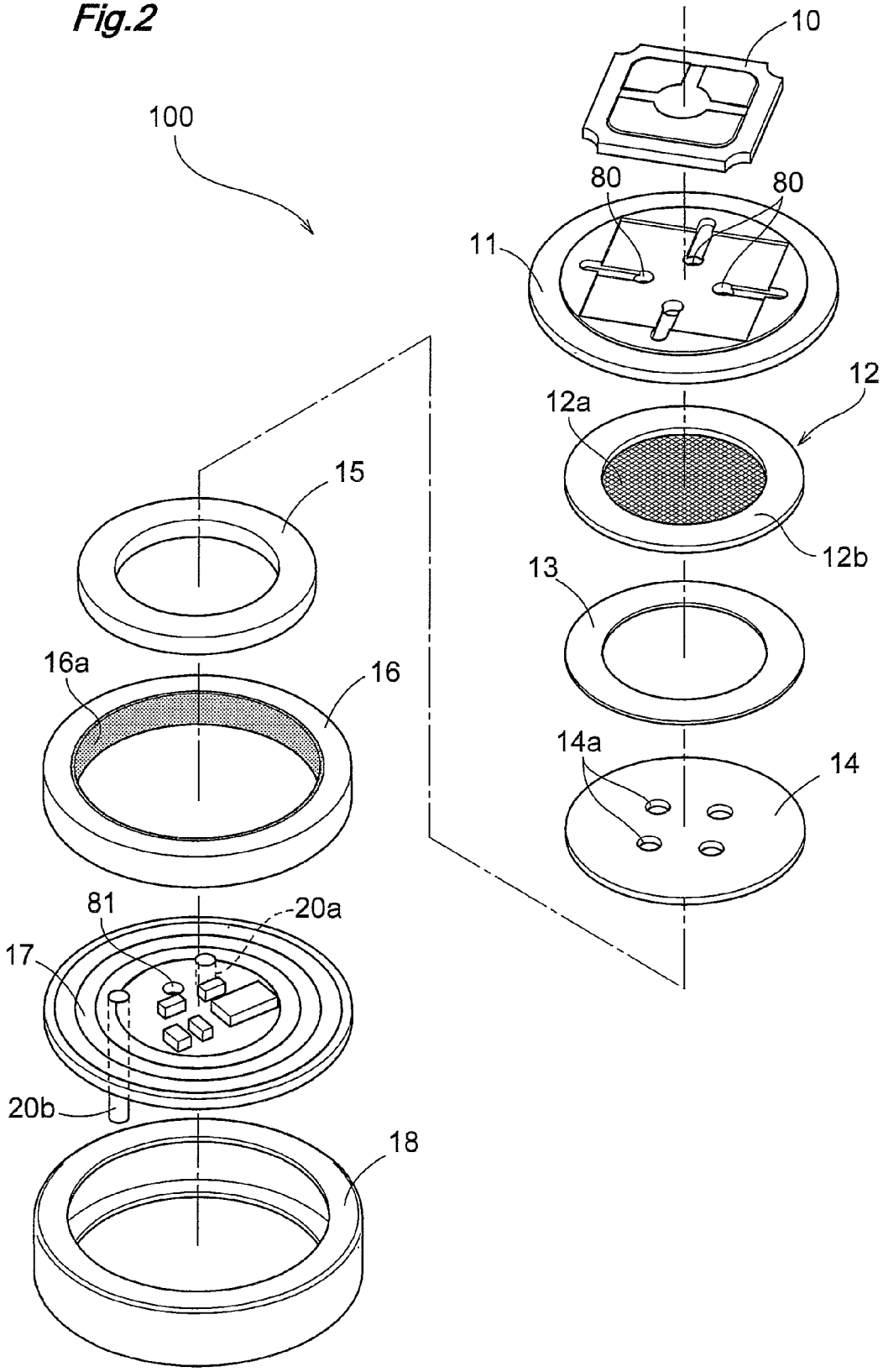
FIG. 2 is a development view of the condenser microphone.
Figure 3:
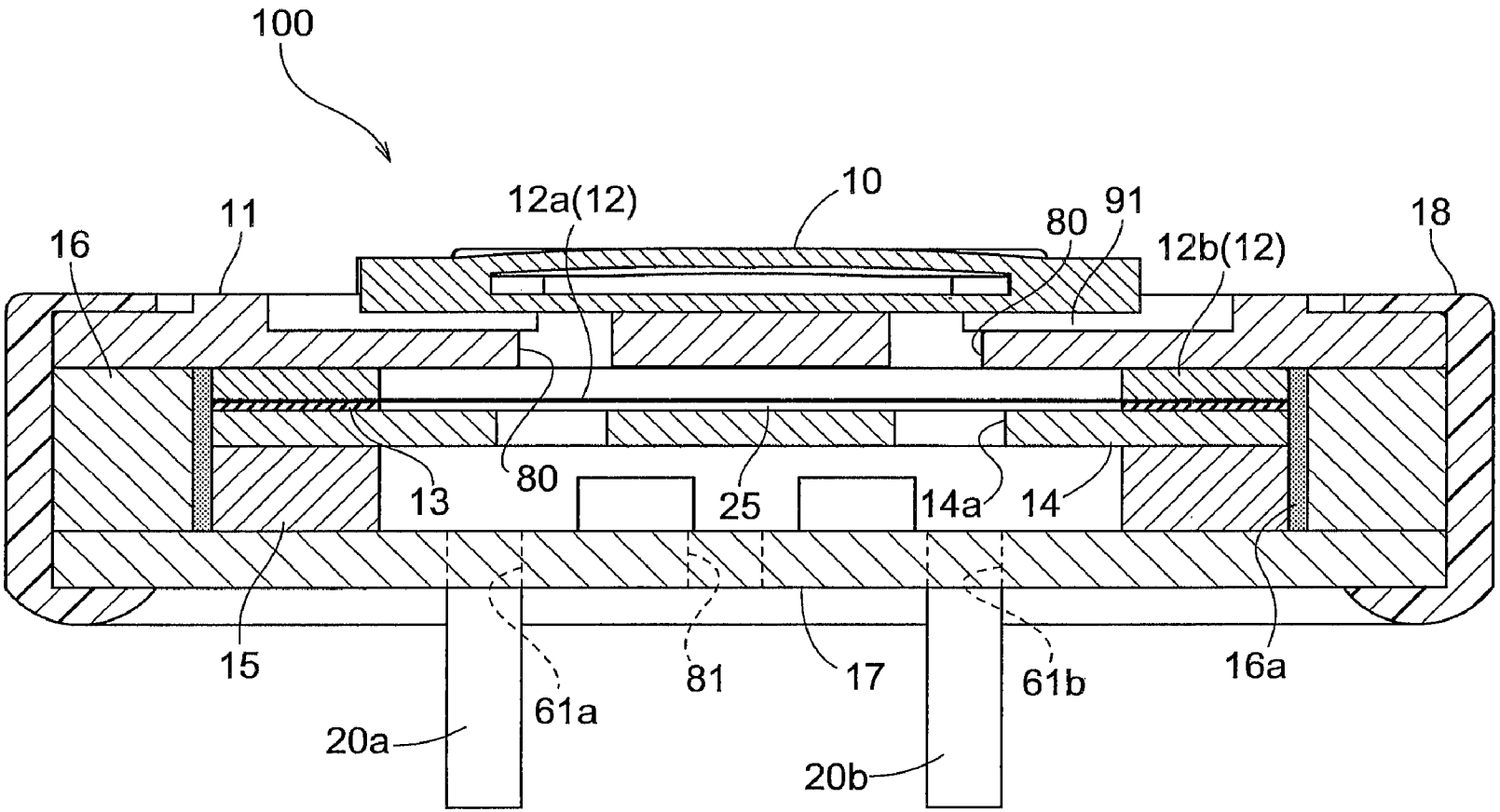
FIG. 3 is a section taken along a III-III line in FIG. 1.

FIG. 2 shows a partial development of the condenser microphone 100. And, FIG. 3 shows a section of the microphone 100 shown in FIG. 1 along III-III line in FIG. 1. The following discussion will be made with reference to FIGS. 2 and 3. The condenser microphone 100 is formed of the respective components, namely, the switch 10, the switch circuit board 11, a diaphragm 12, a spacer 13, a back electrode 14, a gate ring 15, a drain ring 16, the signal processing circuit board 17 and the capsule 18. These components are assembled together in the form of coaxial cylinder and accommodated as such within the capsule 18 in the form of a cylindrical housing.

The diaphragm 12 comprises a disc-shaped member having a diaphragm portion 12*a* and a holding portion 12*b* surrounding this diaphragm portion 12*a*. In the instant embodiment, the diaphragm portion 12*a* is comprised of an electret film. This electret film is formed by a process involving heat-melting a material having low conductance (e.g. polymer material, silicon oxide film, etc.), causing the molten material to solidify between the opposed electrodes, with impingement of a direct current thereon, and subsequently removing the electrodes. The electret film thus produced is charged positively or negatively, but is maintained under the polarized state semi-permanently.

The holding portion 12*b* is formed of an insulating material so as to maintain the polarized state of the electret film of the diaphragm portion 12*a*. With the diaphragm 12 having this construction, its diaphragm portion 12*a* is vibrated by a sound (voice) propagated in the air, so that this sound can be collected. Here, the diaphragm 12 is understood to correspond to what is defined as "a diaphragm electrode" in this invention. Further, the back electrode 14 is provided in the form of a disc shape member made of a conductive material. The back electrode defines a plurality of holes 14*a* extending through this back electrode 14. The back electrode 14 is not vibrated by a sound propagated in the air, but is fixedly mounted within the cylindrical housing. This back electrode 14 is understood to correspond to what is defined as "a fixed electrode" in this invention.

And, between the back electrode 14 and the diaphragm 12, there is disposed an annular spacer 13 made of an insulating material for providing electric insulation between the back electrode 14 and the holding portion 12*b*. Accordingly, in a space 25 between the back electrode 14 and the diaphragm portion 12*a* of the diaphragm 12, there is formed a dielectric gap (air gap) (see FIG. 3). Therefore, the back electrode 14 and the diaphragm 12 together constitute the "capacitor".

The signal processing circuit board 17 is disposed adjacent one open side of the cylindrical housing and includes a converter circuit for converting change occurring in the capacitance of the capacitor in association with vibration of the diaphragm 12 into an electric signal and outputting this electric signal. As described above, the inventive condenser microphone 100 is assembled and mounted within the cylindrical housing. Therefore, this cylindrical housing includes two opposed openings. And, the signal processing circuit board 17 is disposed adjacent one of the openings provided in the cylindrical housing. Preferably, this opening is the one adjacent the back electrode 14 as shown in FIG. 2 and FIG. 3. As will be described later, this arrangement is provided for transmitting electric signals from the back electrode 14 to the signal processing circuit board 17. Further, the converter circuit is constructed of such components as an FET (field effect transistor), a resistor, a capacitor, etc. As this circuit per se is well-known, explanation thereof will be omitted.

Here, the back electrode 14 and the diaphragm 12 together constitute a "capacitor" as described above. Further, the diaphragm 12 (diaphragm portion 12*a*) is vibrated by a sound propagating in the air. Hence, as the diaphragm portion 12*a* is vibrated by a sound, this causes a change in the capacitance of the capacitor. That is, the capacitance of the capacitor varies according to the sound collected by the condenser microphone 100. This capacitance is transmitted from the back electrode 14 via the gate ring 15 to the converter circuit included in the signal processing circuit board 17 and then the converter circuit converts this capacitance (change in the capacitance) transmitted from the capacitor into an electric signal.

The gate ring 15 is disposed between the capacitor and the signal processing circuit board 17 and establishes electric conduction between the capacitor and the signal processing circuit board 17. Here, the "capacitor" refers to the above capacitor constituted from the back electrode 14 and the diaphragm 12. Therefore, as shown in FIG. 2 and FIG. 3, the gate ring 15 is disposed between the back electrode 14 and the signal processing circuit board 17. Further, the gate ring 15 is provided in the form of an annular member made of conductive material. Thus, change in the capacitance can be transmitted from the back electrode 14 to the signal processing circuit board 17.

The switch circuit board 11 is disposed adjacent the opening portion of the cylindrical housing and includes the switch 10 for controlling operation of the converter circuit. As described above, the condenser microphone 100 according to the present invention is assembled and mounted within the cylindrical housing, and adjacent one of the openings of this cylindrical housing, the signal processing circuit board 17 is disposed. And, the switch circuit board 11 is disposed adjacent the other opening of the cylindrical housing, namely, on the side of the opening opposite to the opening where the signal processing circuit board 17. Therefore, the opening where the switch circuit board 11 is disposed corresponds to the opening adjacent the diaphragm 12 as shown in FIG. 2 and FIG. 3. As will be detailed later, this arrangement is provided for facilitating a depressing operation of a switch button 30 included in the switch 10.

The switch 10 is provided with a wire patterning so as to function as a single-pole, opening/closing switch. In response to a depressing operation on the unillustrated switch button 30, the opening/closing switch is closed. In response to a further depressing operation, the opening/closing switch is opened. This opened state renders the converter circuit operable and the closed state renders the converter circuit inoperable. Therefore, the user can effect a desired operation by depressing the switch button 30. Needless to say, it is also possible to employ a different opening/closing switch which is rendered into the closed state only while the user keeps depressing it. That is, a terminal corresponding to the wire patterning as the above-described single-pole opening/closing switch is connected to the switch circuit board 11. Therefore, the closed state and the opened state of the switch 10 can be identified on the side of the switch circuit board 11.

The drain ring 16 is disposed between the switch circuit board 11 and the signal processing circuit board 17 and is configured to transmit a switch signal corresponding to an operation on the switch 10 (switch button 30) to the signal processing circuit board 17. Here, the switch button 30 will be depressed by a user, in the course of which a switch signal corresponding to the opened/closed state of the switch 10 will be outputted. For instance, in the case of the closed state, a switch signal for rendering the converter circuit operable is outputted. In the case of the opened state, a switch signal for rendering the converter circuit inoperable is outputted. The drain ring 16 is provided as an annular member made of a conductive material and is disposed and clamped between the signal processing circuit board 17 and the switch circuit board 11. Therefore, the switch signals can be transmitted in favorable manner from the switch circuit board 11 to the signal processing circuit board 17.

Here, the gate ring 15 and the drain ring 16 are both formed as cylindrical components, with the outer diameter of the gate ring 15 being smaller than the inner diameter of the drain ring 16. As described hereinbefore, the respective components constituting the condenser microphone 100 are formed coaxially cylindrical. Therefore, the gate ring 15 and the drain ring 16 too are formed coaxially cylindrical. Further, the respective inner and outer diameters are set such that the gate ring 15 can be contained at the center portion of the drain ring 16 (the center portion of the cylinder formed by the drain ring 16) as shown in FIG. 2 and FIG. 3. Incidentally, at the inner peripheral portion of the drain ring 16, there is formed an insulating material 16*a* for providing insulation between the gate ring 15 and the drain ring 16.

The capsule 18 is formed as a cylindrical body made of an insulating material. This capsule 18 is configured so as to surround the outermost periphery of the cylinders constituting the switch 10, the switch circuit board 11, the diaphragm 12, the spacer 13, the back electrode 14, the gate ring 15, the drain ring 16 and the signal processing circuit board 17 described above. Therefore, these respective components can be protected electrically and mechanically by the capsule 18.

Figure 4:
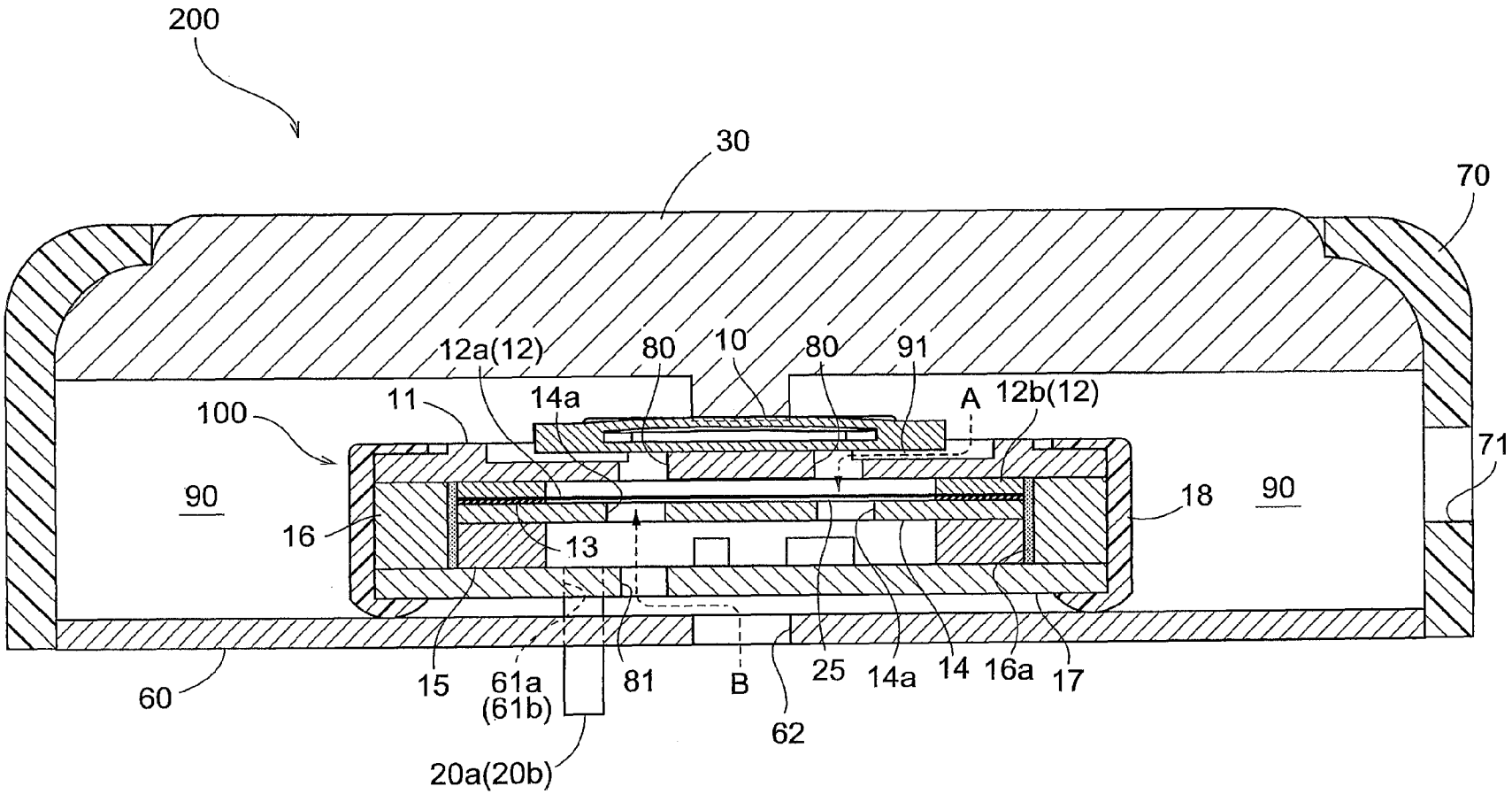
FIG. 4 shows an assembled condition of the condenser microphone.

The condenser microphone 100 is constructed as described above. In the following discussion, there will be described an arrangement wherein the switch button 30 is added to the condenser microphone 100. FIG. 4 shows a section of a condenser microphone unit 200 comprising the condenser microphone 100 and the switch button 30 added thereto. The condenser microphone 100 is supported with insertion of the pair of pin connectors 20*a*, 20*b* into a pair of holes formed in a main circuit board 60. Further, on the upper face of the switch 10, the switch button 30 is mounted. And, a cover member 70 formed of e.g. a resin is provided for covering the lateral side so as to accommodate the condenser microphone 100 together with the switch button 30 and the main circuit board 60. Therefore, the condenser microphone 100, the switch button 30, the main circuit board 60 and the cover member 70 together form a space 90 therebetween.

The cover member 70 includes, in its lateral face, an opening 71 for providing communication between the space 90 described above and the outside. This opening 71 is provided as a hole having a predetermined inner diameter to function as a window for introducing a sound vibration. Further, an opening 62 can be provided also in the main circuit board 60. With this provision of the opening 62 in the main circuit board 60, it is possible to reduce the directional characteristic for introducing the sound vibration.

Preferably, in the switch circuit board 11, there is formed a sound hole 80 for introducing the vibration applied to the diaphragm 12. Preferably, this sound hole 80 is formed perpendicularly upward of at least the diaphragm portion 12*a* of the diaphragm 12. By forming the sound hole 80 at such position as above, the vibration can be transmitted in a favorable manner to the diaphragm 12. A sound (vibration) which has been propagated in the air will reach the diaphragm 12 along a broken line A shown in FIG. 4. More particularly, the sound will reach the diaphragm 12 through the opening 71 (or opening 62), the space 90, a communication hole 91 between the switch 10 and the switch circuit board 11 and the sound hole 80. Therefore, the diaphragm portion 12*a* will be vibrated by this transmitted sound, so that the condenser microphone 100 can detect a change in the capacitance effectively.

In the foregoing embodiment, it was explained that the sound hole 80 formed in the switch circuit board 11 is formed preferably perpendicularly upward of at least the diaphragm portion 12*a* of the diaphragm 12. However, the present invention is not limited thereto. It is a matter of course that the sound hole 80 can be formed at any other portion than the position perpendicularly upward of the diaphragm portion 12*a* of the diaphragm 12.

Further, as shown in FIG. 4, it is also possible as a matter of course to form the sound hole 81 for introducing vibration applied to the diaphragm 12 in the signal processing circuit board 17. The sound (vibration) which has been propagated in the air will reach the diaphragm 12 along a broken line B shown in FIG. 4. More particularly, the sound will reach the diaphragm 12 through the opening 62, the sound hole 81, the hole 14*a* formed in the back electrode 14. With this arrangement, sound collection can be carried out in a favorable manner. Further alternatively, by providing only the opening 62, not providing the opening 71, it becomes possible to make the opening 62 less conspicuous. So, the deterioration of the aesthetic of the product can be avoided.

Figure 5:
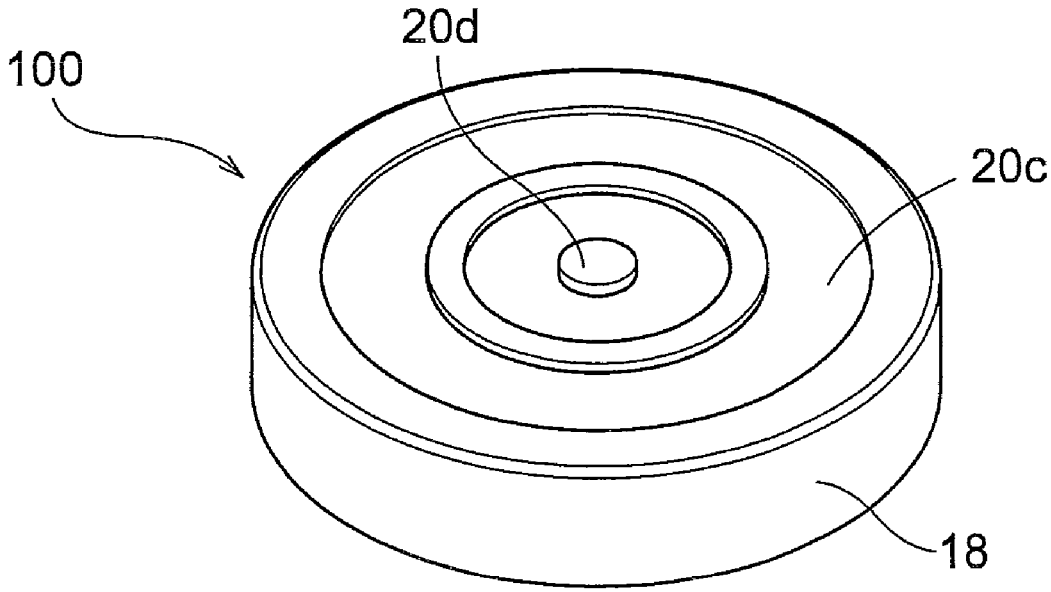
FIG. 5 is a view showing electrodes relating to a further embodiment.

In the foregoing embodiment, it was explained that one of the pin connectors 20*a*, 20*b* is an output terminal and the other is a GND terminal. However, the present invention is not limited thereto. It is needless to say that without using the pin connectors 20*a*, 20*b*, surface-mounted type electrodes (lands 20*c*, 20*d*) can also be used as shown in FIG. 5.

In the foregoing embodiment, it was explained that the condenser microphone 100 has the microphone function. However, the present invention is not limited thereto. Needless to say, the invention can be applied also to one having an earphone function.

In the foregoing embodiment, it was explained that an electret film is formed in the diaphragm portion 12*a*. However, the present invention is not limited thereto. For instance, it is needless to say that an electret film may be formed (electrically charged) to a film laminated on the back electrode 14.

The present invention may be applied to a condenser microphone configured to convert into an electric signal a change in capacitance of a capacitor comprised of a diaphragm electrode and a fixed electrode.

DESCRIPTION OF REFERENCE NUMERALS AND MARKS

10: switch
11: switch circuit board
12: diaphragm (diaphragm electrode)
12*a*: diaphragm portion
12*b*: holding portion
13: spacer
14: back electrode (fixed electrode)
14*a*: hole
15: gate ring
16: drain ring
16*a*: insulating material
17: signal processing circuit board
18: capsule (cylindrical housing)
20*a*: pin connector
20*b*: pin connector
80: sound hole
81: sound hole
100: condenser microphone

The invention claimed is:

1. A condenser microphone, comprising, as all being accommodated within a cylindrical housing:

a capacitor including a diaphragm electrode and a fixed electrode;

a signal processing circuit board disposed at one opening of the cylindrical housing and having a converter circuit for converting a change in capacitance of the capacitor which has occurred in association with vibration of the diaphragm electrode into an electric signal and outputting this electric signal;

a gate ring disposed between the capacitor and the signal processing circuit board and provided in contact with the capacitor and the signal processing circuit board for establishing electric conduction therebetween;

a switch circuit board disposed at the other opening of the cylindrical housing and having a switch for controlling operation of the converter circuit; and a drain ring disposed between the switch circuit board and the signal processing circuit board and in contact with the switch circuit board and the signal processing circuit board for transmitting a switch signal according to an operation of the switch to the signal processing circuit board.

2. The condenser microphone according to claim 1, wherein the gate ring has an outer diameter smaller than an inner diameter of the drain rings such that drain ring surrounds the gate ring when the drain ring and the gate ring are accommodated within the cylindrical housing.

3. The condenser microphone according to claim 1, wherein a sound hole for introducing vibration applied to the diaphragm electrode is formed in the switch circuit board.

4. The condenser microphone according to claim 2, wherein a sound hole for introducing vibration applied to the diaphragm electrode is formed in the signal processing circuit board.

5. The condenser microphone according to claim 1, wherein a sound hole for introducing vibration applied to the diaphragm electrode is formed in the signal processing circuit board.

6. The condenser microphone according to claim 2, wherein a sound hole for introducing vibration applied to the diaphragm electrode is formed in the signal processing circuit board.

7. The condenser microphone according to claim 3, wherein a sound hole for introducing vibration applied to the diaphragm electrode is formed in the signal processing circuit board.

* * * * *